US010921074B2

(12) United States Patent
Day

(10) Patent No.: US 10,921,074 B2
(45) **Date of Patent: *Feb. 16, 2021**

(54) METHOD FOR OPERATING GUN HAVING MULTI-DRIVE LINK FEED SYSTEM

(71) Applicant: Daycraft Weapon Systems, LLC, Phoenix, AZ (US)

(72) Inventor: Richard C. Day, Gilbert, AZ (US)

(73) Assignee: Daycraft Weapon Systems, Inc., Phoenix, AZ (US)

( * ) Notice: Subject to any disclaimer, the term of this patent is extended or adjusted under 35 U.S.C. 154(b) by 84 days.

This patent is subject to a terminal disclaimer.

(21) Appl. No.: 16/460,849

(22) Filed: Jul. 2, 2019

(65) Prior Publication Data

US 2019/0339034 A1 Nov. 7, 2019

Related U.S. Application Data

(62) Division of application No. 15/960,197, filed on Apr. 23, 2018, now Pat. No. 10,352,638.

(51) Int. Cl.
*F41A 9/00* (2006.01)
*F41A 9/31* (2006.01)

(52) U.S. Cl.
CPC ..... *F41A 9/31* (2013.01)

(58) Field of Classification Search
CPC ..... F41A 9/31; F41A 9/30; F41A 9/49; F41A 7/08; F16H 27/06
USPC ..... 89/33.25, 34, 11, 33.04, 33.16
See application file for complete search history.

(56) References Cited

U.S. PATENT DOCUMENTS

| | | | |
|---|---|---|---|
| 3,333,506 | A | 8/1967 | Henshaw |
| 3,747,469 | A | 7/1973 | Ashley |
| 4,244,270 | A | 1/1981 | Tassie |
| 4,397,216 | A | 8/1983 | Tassie |
| 4,418,607 | A | 12/1983 | Price |
| 4,481,858 | A | 11/1984 | Price |
| 4,563,936 | A | 1/1986 | Cleary |
| 4,606,235 | A | 8/1986 | Kindt |
| 4,612,843 | A | 9/1986 | Marcon |
| 4,658,701 | A | 4/1987 | Moore |
| 4,779,522 | A | 10/1988 | Wong |
| 4,781,100 | A | 11/1988 | Baldwin |
| 4,833,966 | A | 5/1989 | Maher |

(Continued)

OTHER PUBLICATIONS

"Mechanisms for Intermittent Motion", by John H. Bickford, Industrial Press Inc., New York, copyright 1972, 15 pages.

*Primary Examiner* — Michael D David
(74) *Attorney, Agent, or Firm* — Haynes and Boone, LLP

(57) ABSTRACT

A method of feeding rounds of linked, or un-linked, ammunition to a gun includes a motor-driven chain drive which rotates about a track. A rotatable feeder engages the ammunition to feed an ammunition round into a round extractor/retractor. A rotatable round positioner receives an ammunition round from the round extractor/retractor, and rotates it to a firing position. A main geneva wheel, mounted near the chain drive, is sequentially engaged by first and second drive rollers, secured to the chain drive, for being periodically rotated thereby. Drive pins of the main geneva wheel sequentially engage radial slots in a belt/round feed geneva wheel and a round positioning geneva wheel for timed rotation thereof to synchronize the operation of the round feeder and round positioner.

16 Claims, 9 Drawing Sheets

(56) References Cited

U.S. PATENT DOCUMENTS

| | | | | |
|---|---|---|---|---|
| 5,111,732 | A | 5/1992 | Marcon | |
| 5,218,162 | A | 6/1993 | Bender-Zanoni | |
| 5,458,044 | A | 10/1995 | Delbos | |
| 6,443,044 | B1 | 9/2002 | Dillon | |
| 7,971,515 | B2 | 7/2011 | Garwood | |
| 8,413,565 | B2 | 4/2013 | Herrmann | |
| 8,601,929 | B2 | 12/2013 | Stevenson | |
| 8,607,683 | B1 | 12/2013 | Burgermeister | |
| 8,616,112 | B2 | 12/2013 | Hermann | |
| 9,638,483 | B1 | 5/2017 | Hoffman | |
| 10,352,638 | B1 * | 7/2019 | Day | F41A 9/38 |
| 2008/0115623 | A1 | 5/2008 | Naude | |
| 2012/0144712 | A1 | 6/2012 | Rostocil | |
| 2016/0305740 | A1 | 10/2016 | O'Donnell | |

* cited by examiner

METHOD FOR OPERATING GUN HAVING MULTI-DRIVE LINK FEED SYSTEM

CROSS-REFERENCE TO RELATED PATENT APPLICATION

This non-provisional patent application is a divisional of, and claims the benefit of the earlier filing date of, prior-filed U.S. non-provisional patent application Ser. No. 15/960,197, filed on Apr. 23, 2018, entitled "Gun Having Multi-Drive Link Feed System And Method Therefor", under 35 U.S.C. 120.

BACKGROUND OF THE INVENTION

1. Field of the Invention

The present invention relates generally to guns for automatically firing rounds of ammunition secured to an ammunition belt, and more particularly, to an apparatus and method using geneva wheels to synchronize the feeding of rounds to the gun for extraction with the positioning of extracted rounds for firing.

2. Description of the Relevant Art

Automatic, rapid-firing weapons are often included in military aircraft, naval ships, and ground-based military vehicles. Typically, such weapons are designed to receive rounds of ammunition that are clipped together to form an ammunition belt. The ammunition belt is fed into the weapon, rounds are extracted from the belt and fired, and spent casings are ejected from the weapon; all of these steps are performed automatically and continuously, at least for so long as the operator is depressing a trigger button.

It is known in the art to use a chain drive system to control the firing of ammunition rounds. For example, in U.S. Pat. No. 4,418,607 issued to Price, an automatic weapon is described wherein a chain drive assembly is used to control the timing and sequence of operations. A motor rotates the chain drive via a drive sprocket and several idler sprockets. The chain drive includes a special link which carries a bolt drive shoe and a geneva drive roller. The bolt drive shoe is received within a slot formed on the underside of the bolt carrier to reciprocate the bolt carrier along support rails as the chain rotates. The geneva drive roller engages a geneva wheel having three slots formed therein, each of which is adapted to slidingly receive the geneva drive roller. For each complete rotation of the chain drive, the geneva drive roller rotates the geneva wheel through an angle of 120 degrees. The shaft of the geneva wheel is coupled by gears to a feed rotor which feeds rounds to a bolt carrier. This feed rotor is rotated in an intermittent fashion by the geneva wheel. On the other hand, the linked rounds within the ammunition belt are fed into the feed rotor by a feed sprocket that is rotated at a continuous rate by the same motor that rotates the chain drive.

In U.S. Pat. No. 4,563,936, issued to Cleary, et al., a similar weapon is described, but wherein the feed sprockets, used to feed rounds to the feed rotor, are continuously driven at a non-uniform, oscillating angular velocity, thereby delaying the transfer of rounds to the feed rotor until the last possible moment. This non-uniform angular velocity of the feed sprockets is achieved either through use of a rather complicated gear transmission using a planet gear and stationary ring gear, or through the use of a cam follower guided in a race of a stationary cam.

Geneva wheel drive mechanisms are well known for producing incremental rotation of drive shafts; see, e.g., U.S. Pat. No. 4,606,235 issued to Kindt. In U.S. Pat. No. 4,779,522 issued to Wong, a drive mechanism is disclosed for an automatic cooking apparatus wherein a driver support disc rotates a pair of geneva wheels. The driver support disc includes a drive pin positioned near its outer periphery. The drive pin alternately engages radial slots formed in the two geneva wheels, which are disposed on opposing sides of the driver support disc. The two geneva wheels, in turn, rotate a pair of shafts in alternating, intermittent fashion.

To the best of applicant's knowledge, those skilled in the art of automatic gun design have not applied multiple geneva wheels in a chain-drive automatic weapon to positively synchronize the feeding of ammunition into the gun with the positioning of extracted rounds in a firing position.

It is an object of the present invention to provide a gun for firing ammunition rounds from a linked ammunition belt wherein the feeding of ammunition into the gun, de-linking and extraction of rounds from the ammunition belt, and positioning of extracted rounds in a firing position, can all be directly synchronized by a relatively simple apparatus.

It is further object of the present invention to provide such a gun wherein the steps of feeding of ammunition into the gun, de-linking and extraction of rounds from the ammunition belt, and positioning of extracted rounds in a firing position, can be positively maintained in synchronization without significant loss of power.

It is a further object of the present invention to provide such a gun wherein the aforementioned feeding, de-linking, extraction and positioning operations are each intermittent operations that are easily coordinated with each other.

It is still a further object of the present invention to provide such a gun wherein the same basic configuration can be used to feed, de-link, extract and position a wide variety of different types and sizes of ammunition rounds.

Still another object of the present invention is to provide such a gun which supports a firing rate of up to 1,000 rounds per minute.

A yet further object of the present invention is to provide such a gun capable of receiving and firing un-linked rounds from an ammunition magazine or the like.

It is also an object of the present invention to provide a method of operating a gun in a manner that achieves the features described above.

These and other objects of the invention will become more apparent to those skilled in the art as the description of the present invention proceeds.

SUMMARY OF THE INVENTION

Briefly described, and in accordance with one aspect thereof, the present invention provides a gun for firing rounds from an ammunition belt, including a chain drive supported for rotation about a track, and a motor coupled to the chain drive for rotating the chain drive. The gun includes a round extractor for extracting a round of ammunition from the ammunition belt. The gun also includes a rotatable belt feeder for engaging the ammunition belt to feed a round of ammunition into the round extractor. In addition, the gun includes a rotatable round positioner which receives a round of ammunition from the round extractor, and rotates the received round of ammunition to a firing position. A main geneva wheel is mounted for rotation near the chain drive, and is periodically rotated thereby. A belt feed geneva wheel is rotatably mounted near the main geneva wheel for being periodically rotated thereby. Also, a round positioning geneva wheel is rotatably mounted proximate the main geneva wheel for being periodically rotated thereby. The belt feed geneva wheel is, in turn, coupled to the aforementioned belt feeder for periodically rotating the belt feeder. Similarly, the round positioning geneva wheel is, in turn, coupled to the round positioner for periodically rotating the round positioner.

In various embodiments of the invention, first and second drive link rollers are coupled to the chain drive, each serving to partially rotate the main geneva wheel as each such drive link roller passes the main geneva wheel. During each complete rotation of the chain drive, the main geneva wheel is rotated by the first drive link roller through a first angular rotation of 90 degrees, and the main geneva wheel is rotated by the second drive link roller through a second angular rotation of 90 degrees, for a total of 180 degrees for each complete rotation of the chain drive. In some embodiments of the invention, during each complete rotation of the chain drive, the main geneva wheel rotates the belt feed geneva wheel by 90 degrees in response to the first drive link roller, and rotates the round positioning geneva wheel by 90 degrees in response to the second drive link roller.

In various embodiments of the invention, the gun includes a breech for receiving a round of ammunition to be fired, and a bolt carrier for delivering the round of ammunition to the breech for firing. The bolt carrier is mounted for sliding movement alternately toward and away from the breech. The bolt carrier is engaged with the chain drive for being reciprocated toward, and away from, the breech during each complete rotation of the chain drive. In some embodiments, the bolt carrier includes a laterally-extending track. A cam is coupled to the chain drive for rotation therewith about the track; the cam is engaged by, and slides within, the track of the bolt carrier, to move the bolt carrier forward and rearward, relative to the gun breech, during each complete rotation of the chain drive. The round extractor may be coupled to the bolt carrier for sliding movement therewith.

In various embodiments of the invention, the main geneva wheel includes first, second, third and fourth pockets. The first and third pockets alternately receive the first drive link roller, and the second and fourth pockets alternately receive the second drive link roller. In some embodiments, the belt feed geneva wheel rotates about a first axle, the round positioning geneva wheel rotates about a second axle, and the main geneva wheel rotates about a third axle, with the first and second axles being equidistant from the third axle.

In various embodiments, the main geneva wheel includes first and second pins that are diametrically-opposed from each other. The first such pin is adapted to engage and rotate the belt feed geneva wheel, and thereafter engage and rotate the round positioning geneva wheel. Likewise, the second such pin is adapted to engage and rotate the belt feed geneva wheel, and thereafter engage and rotate the round positioning geneva wheel. In some embodiments, the belt feed geneva wheel and the round positioning geneva wheel each have radial slots formed therein for receiving one of the first and second pins of the main geneva wheel. As the main geneva wheel rotates, one of the first and second pins enters and exits a radial slot of the belt feed geneva wheel, and thereafter enters and exists a radial slot of the round positioning geneva wheel. In some embodiments, at least one detent is provided near either the belt feed geneva wheel or the round positioning geneva wheels. The detent yieldingly engages its associated geneva wheel to maintain its associated geneva wheel in a fixed position until such geneva wheel is engaged and rotated by one of the first and second pins of the main geneva wheel.

In various embodiments of the invention, the belt feed geneva wheel and the round positioning geneva wheel are positioned closely proximate to each other and to the main geneva wheel. The belt feed geneva wheel rotates about a first axle, and the round positioning geneva wheel rotates about a second axle; in some embodiments, the radius of the round positioning geneva wheel is substantially equal to the radius of the belt feed geneva wheel, and the distance separating the first and second axles is only slightly greater than the sum of the radii of the belt feed geneva wheel and the round positioning geneva wheel. This positioning permits each of the first and second pins of the main geneva wheel to enters a radial slot of the round positioning geneva wheel substantially immediately after leaving a radial slot of the belt feed geneva wheel.

Another aspect of the present invention regards a method of feeding of rounds of ammunition from an ammunition belt to a gun, and positioning rounds for firing within the gun. In practicing such method in accordance with various embodiments of the invention, a chain drive is selectively rotated about a track. First and second drive links are secured to the chain drive, with the first and second drive links being spaced apart from each other. A main geneva wheel is mounted for rotation near the chain drive whereby the first and second drive links periodically travel past the main geneva wheel as the chain drive is rotated.

In practicing such method, the main geneva wheel is rotated through a first partial rotation as the first drive link travels past the main geneva wheel; the main geneva wheel is rotated through a second partial rotation as the second drive link travels past the main geneva wheel.

A belt feed geneva wheel is mounted for rotation proximate the main geneva wheel for being periodically rotated thereby. A round extractor is provided for engaging and extracting a round of ammunition. A rotating belt feeder is also provided for periodically feeding a round of ammunition into the round extractor. The belt feet geneva wheel is coupled to the rotating belt feeder for periodically rotating the belt feeder to feed a round of ammunition into the round extractor.

In various embodiments, the inventive method also includes the step of providing a rotatable bolt feed rotor which positions an extracted round for firing. In some embodiments, the method includes the step of transferring an extracted round of ammunition from the round extractor to the bolt feed rotor. Also, a round positioning geneva wheel is mounted for rotation near the main geneva wheel for being periodically rotated thereby. Some embodiments of the present method include the step of coupling the round positioning geneva wheel with the bolt feed rotor to properly sequence rotation of an extracted round of ammunition into alignment with the barrel of the gun. In some embodiments, a detent is yieldingly engaged with at least one of the belt feed and round positioning geneva wheels for maintaining the engaged geneva wheel in a fixed position until such engaged geneva wheel is further rotated by the main geneva wheel.

In practicing the method in accordance with various embodiments, the first drive link is provided with a first roller; the second drive link is provided with a second roller; and a series of pockets are provided within the main geneva wheel. The first roller engages one of the pockets in the main geneva wheel as the chain drive rotates the first drive link past the main geneva wheel. Similarly, the second roller engages one of the pockets in the main geneva wheel as the chain drive rotates the second drive link past the main geneva wheel. In some embodiments, the first roller is used to rotate the main geneva wheel through a first angular rotation of 90 degrees over a first period of time, and the second roller is used to rotate the main geneva wheel through a second angular rotation of 90 degrees over a second period of time. The main geneva wheel is engaged with the belt feed geneva wheel during the first period of time to rotate the belt feed geneva wheel by 90 degrees; likewise, the main geneva wheel is engaged with the round positioning geneva wheel during the second period of time to rotate the round positioning geneva wheel by 90 degrees.

In practicing the present method in accordance with some embodiments thereof, opposing first and second pins are provided on the main geneva wheel; radial slots are provided in the belt feed geneva wheel; and radial slots are provided in the round positioning geneva wheel. In some of these embodiments, the method includes the steps of periodically engaging one of the first and second pins with one of the radial slots in the belt feed geneva wheel to rotate the belt feed geneva wheel through a partial rotation; and periodically engaging one of the first and second pins with one of the radial slots in the round positioning geneva wheel to rotate the round positioning geneva wheel through a partial rotation. In practicing at least some embodiments of the present method, the belt feed geneva wheel is positioned in close proximity to the round positioning geneva wheel; each of the first and second pins of the main geneva wheel enters a radial slot of the round positioning geneva wheel substantially immediately after exiting from a radial slot of the belt feed geneva wheel.

While the invention has been summarized above in regard to linked ammunition, i.e., rounds of ammunition linked together to form belts, the present invention may also be advantageously practiced within a gun adapted to fire un-linked rounds of ammunition. Such gun still includes a chain drive supported for rotation about a track, as well as a motor coupled to the chain drive for rotating the chain drive around the track. The main geneva wheel is mounted for rotation proximate to the chain drive for being periodically rotated thereby. The round feed geneva wheel, and round positioning geneva wheel, are still mounted for rotation proximate to the main geneva wheel for being periodically rotated thereby. While a round extractor is no longer required, a round retractor is provided for securing and retracting fresh rounds. A rotatable round feeder engages fresh rounds of ammunition and feeds them to the round retractor; the round feeder is coupled to the round feed geneva wheel and is periodically rotated thereby. A rotatable round positioner receives a round of ammunition from the round retractor and rotates the round of ammunition to a firing position; the round positioner is coupled to the round positioning geneva wheel for being periodically rotated thereby.

Similarly, while the method of the present invention has been described above in regard to belted, or linked, ammunition rounds, the present invention also encompasses a method of feeding of rounds of un-linked ammunition to a gun and positioning rounds for firing within the gun. In practicing such method, a chain drive is selectively rotated about a track; first and second drive links are secured to the chain drive, spaced apart from each other. A main geneva wheel is mounted for rotation proximate the chain drive, whereby the first and second drive links periodically travel past the main geneva wheel. The main geneva wheel is rotated through a first partial rotation as the first drive link travels past the main geneva wheel, and rotated through a second partial rotation as the second drive link travels past the main geneva wheel. A round feed geneva wheel is rotatably mounted proximate to the main geneva wheel for being periodically rotated thereby.

A round retractor is also provided for engaging and retracting rounds of ammunition. The round feed geneva wheel is coupled to a rotating round feeder for periodically feeding a round of ammunition into the round retractor. A rotatable bolt feed rotor is provided, and a retracted round of ammunition is transferred from the round retractor to the bolt feed rotor. A round positioning geneva wheel is rotatably mounted proximate to the main geneva wheel for being periodically rotated thereby. The round positioning geneva wheel is coupled with the bolt feed rotor to move a retracted round of ammunition into alignment with the barrel of the gun.

BRIEF DESCRIPTION OF THE DRAWINGS

FIGS. 11-22 are a series of sequential perspective views similar to that of FIG. 3 showing the sequence of operations performed to feed, extract, position, fire, and eject rounds of ammunition on a continuous basis, wherein:

FIG. 11 shows the bolt carrier in its forward position before feeding a next round into the round extractor;

FIG. 12 shows the bolt carrier in its forward position, and the belt feeder beginning to feed a next round into the round extractor;

FIG. 13 shows the bolt carrier in its forward position, after the belt feeder has completed feeding the next round into the round extractor;

FIG. 14 shows the bolt carrier having been retracted to its rearmost position, with the extracted round positioned within the round positioner;

FIG. 15 shows the bolt carrier in its rearmost position, with the round having been rotated by 90 degrees;

FIG. 16 shows the bolt carrier in its rearmost position, with the round having been rotated by an additional 90 degrees, in axial alignment with the barrel of the gun;

FIG. 17 shows the bolt carrier moved back to its forward position for advancing the positioned round within the barrel of the gun;

FIG. 18 shows the bolt carrier in its forward position, after the expended round has been fired, and after the next round has been fed by the belt feeder into the round extractor;

FIG. 19 shows the bolt carrier moved back to its rearmost position, with the expended round at the bottom of the round positioner, and the next round positioned within the top of the round positioner;

FIG. 20 shows the bolt carrier in its rearmost position, with the expended round rotated by 90 degrees to an ejector position, and with the next round having been rotated by 90 degrees within the round positioner;

FIG. 21 shows the bolt carrier in its rearmost position, with the expended round still in the ejector position, and with the next round having been rotated by an additional 90 degrees, in axial alignment with the barrel of the gun; and FIG. 22 shows the bolt carrier moved back to its forward-most position for advancing the positioned round into the barrel of the gun, and for ejecting the expended round from the round positioner.

DETAILED DESCRIPTION OF THE PREFERRED EMBODIMENT

Figure 1:
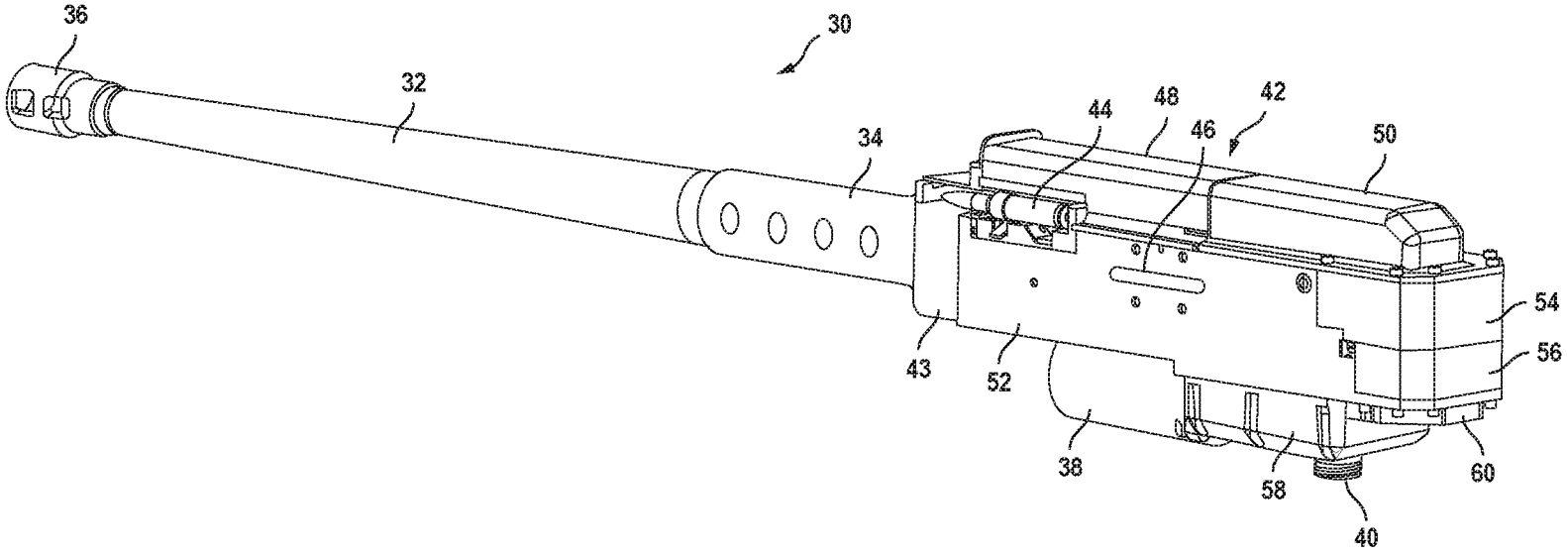
FIG. 1 is a perspective view of a gun constructed in accordance with a preferred embodiment of the present invention, including the barrel and barrel support tube.
Figure 11:
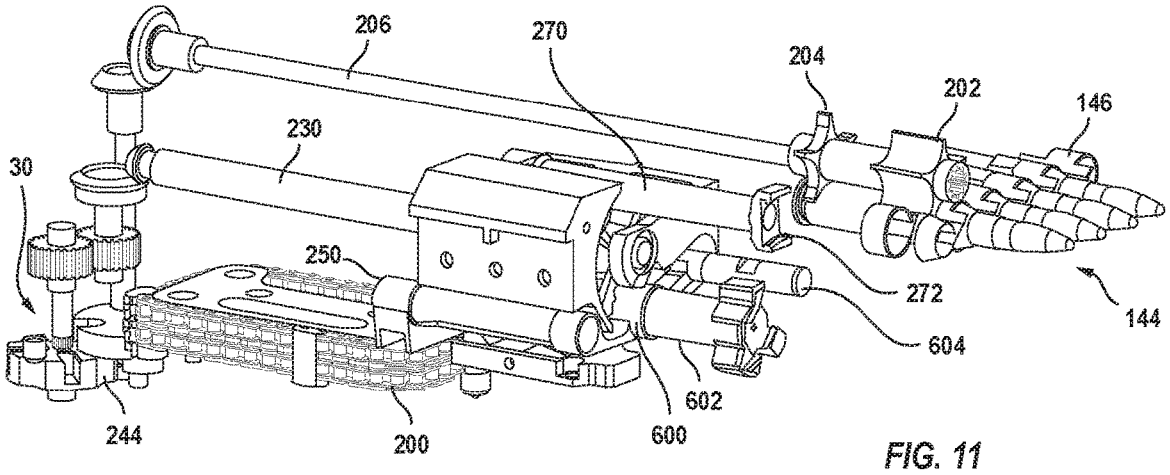

A preferred form of gun constructed in accordance with the teachings of the present invention is designated generally in FIG. 1 by reference numeral 30. Gun 30 includes a barrel 32, barrel support tube 34, muzzle break 36, drive motor 38, mounting post 40, and housing assembly 42. A barrel support base 43 secures barrel 32 and barrel support tube 34 to the front end of housing assembly 42. An incoming round of ammunition (one of many such rounds on a linked ammunition belt) is designated by reference numeral 44. Referring briefly to FIG. 11, a group of such ammunition rounds 44 is linked together by links 146 to form a linked ammunition belt 144.

Ejector guide 46 extends from housing assembly 42 for ejecting spent rounds from gun 30. Housing assembly 42 includes a forward upper cover 48, a rearward upper cover 50, a receiver 52, a rear feeder housing 54, a rear feeder plate 56, a motor mount 58, and a feeder bottom cover 60.

Figure 2:
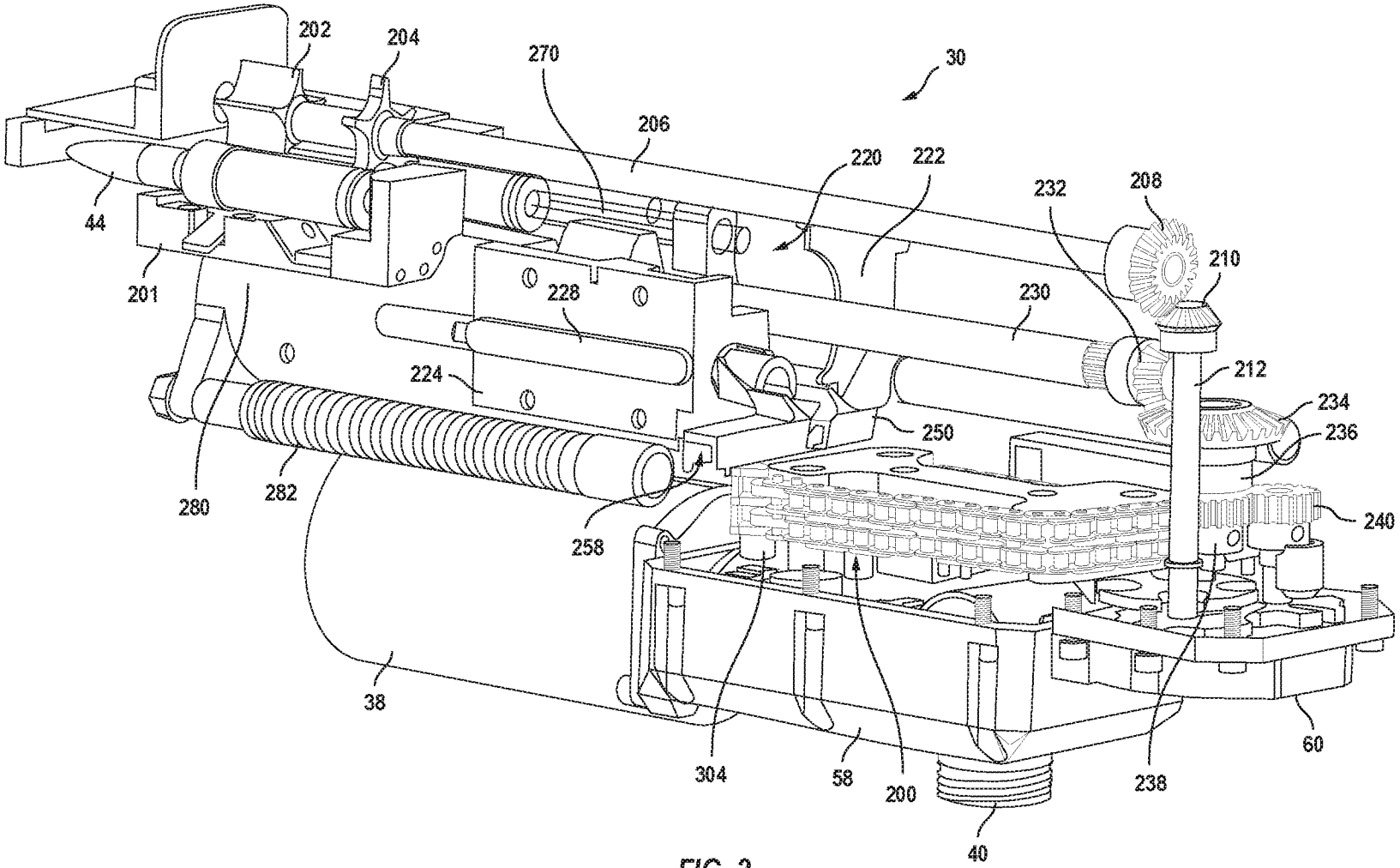
FIG. 2 is a perspective view of the primary components of the gun shown in FIG. 1, omitting the barrel and barrel support tube, and with the upper covers removed.

In order to visualize the working parts of gun 30, FIG. 2 of the drawings omits the gun barrel 32, barrel support base 43, forward upper cover 48, rearward upper cover 50, receiver 52, rear feeder housing 54, and rear feeder plate 56. Electric drive motor 38 is the main source of motive power for driving the moving components of gun 30. When electric power is applied to the terminals of drive motor 38, gun 30 will fire rounds of ammunition; when electric power is removed from the terminals of drive motor 38, it stops firing rounds of ammunition. The control mechanism for selectively applying electric power to drive motor 38 could be as simple as a trigger-style electrical "fire" switch in the form of a button depressed by an operator; in this case, such an electrical switch would be coupled in series with the source of electrical power and one of the terminals of drive motor 38; when the operator depresses the switch, electrical power is applied, drive motor 38 rotates, and gun 30 fires rounds of ammunition. More complicated trigger control mechanisms may be used, if desired, but the basic operation of gun 30 remains the same, i.e., if electrical power is applied across the terminals of drive motor 38, gun 30 will fire rounds of ammunition.

Figure 3:
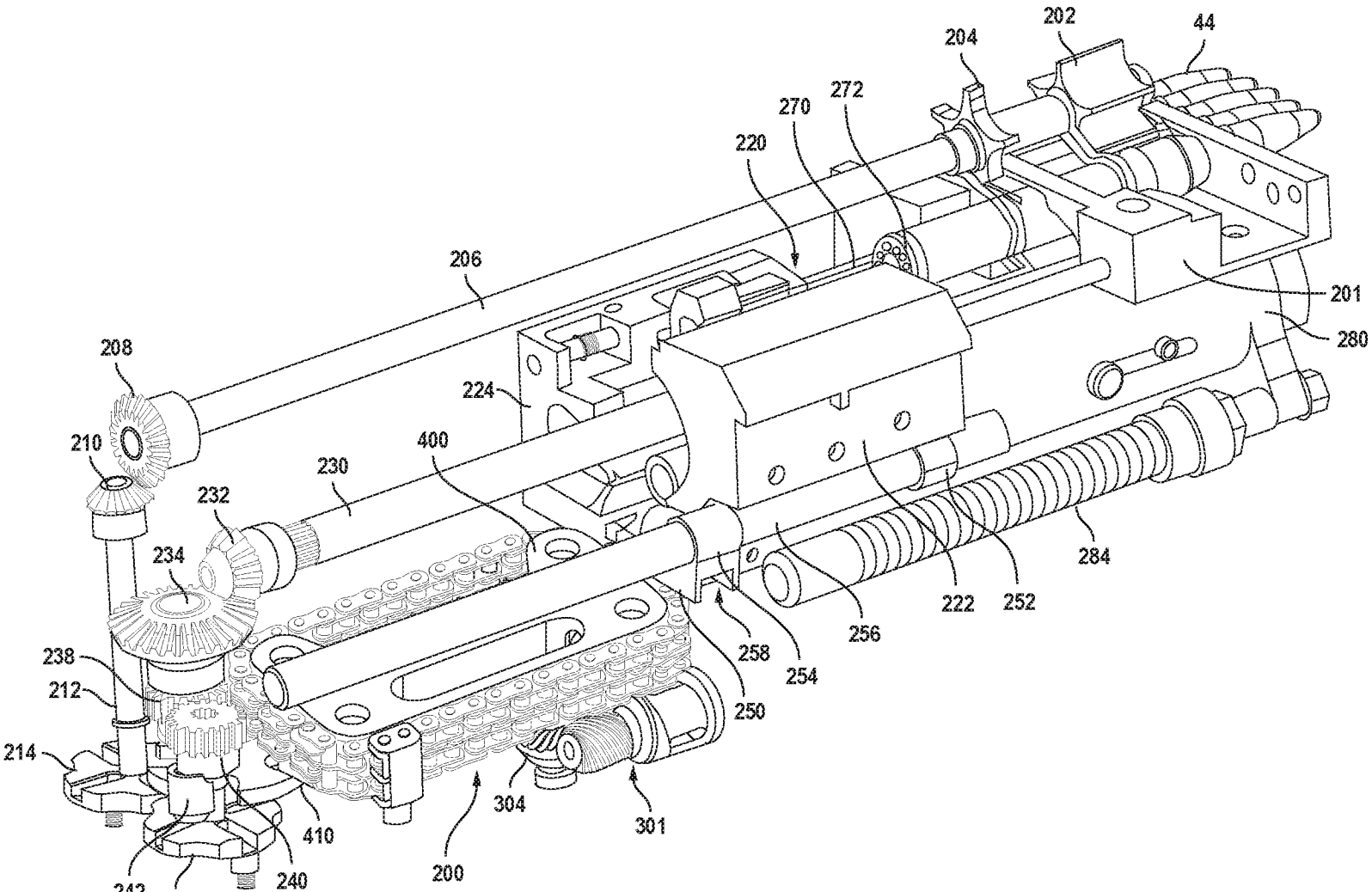
FIG. 3 is a simplified perspective view of FIG. 2, focusing primarily upon the components which relate to the feeding, extraction, positioning, and ejection of ammunition rounds.
Figure 4:
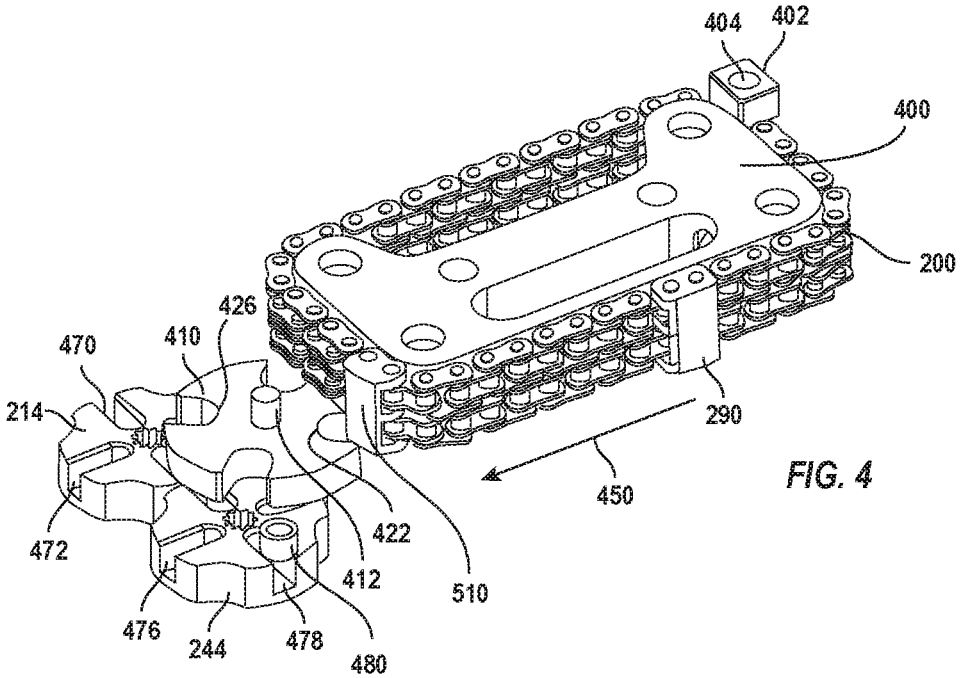
FIG. 4 is a perspective view of a chain drive, main geneva wheel, belt feeding geneva wheel, and round positioning geneva wheel.
Figure 5:
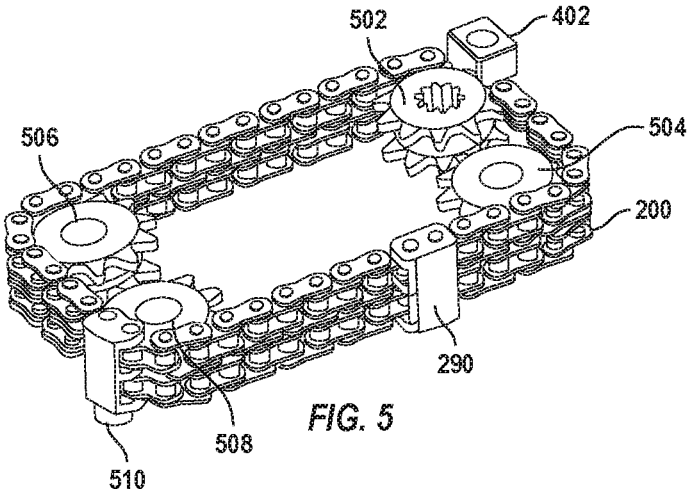
FIG. 5 is an upper perspective view of the chain drive assembly.
Figure 6:
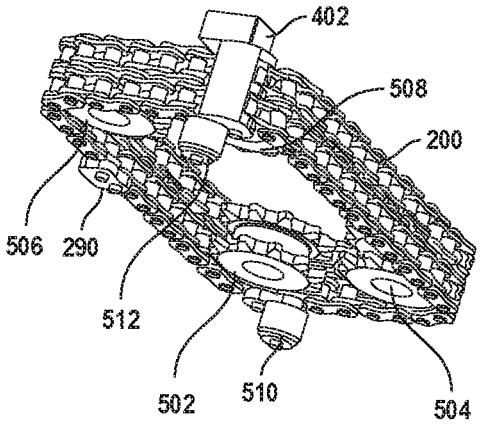
FIG. 6 is a lower perspective view of the chain drive assembly.

The shaft of drive motor 38 is coupled, via a motor drive gear/helical clutch shown as 301 in FIG. 3, to a chain drive shaft shown as 304 in FIGS. 2 and 3. The lower portion of chain drive shaft 304 includes a gear engaged with the motor drive gear for being rotated thereby. The upper portion of chain drive shaft 304 engages a drive sprocket best shown as 502 in FIGS. 5 and 6. Drive sprocket 502 engages the upper and lower links of chain drive loop 200, and rotates chain drive loop 200 whenever drive motor 38 is operated. As shown best in FIG. 4, a fixed dogbone track 400 provides structural support for chain drive loop 200. One corner of dogbone track 400 rotatably supports chain drive shaft 304 to facilitate engagement of chain drive loop 200 with drive sprocket 502. Three idler sprocket gears 504, 506 and 508, shown in FIGS. 5 and 6, are rotatably supported at the other three corners of dogbone track 400, and serve to rotatably support chain drive loop 200 as it rotates around dogbone track 400. In the preferred embodiment, chain drive loop 200 includes a master link 290 used to open and close chain drive loop 200. While chain drive loop 200 is preferably formed of dual-linked hardened steel chains, chain drive loop 200 may also encompass other forms of power transmission belts that are adapted to be driven by sprocket gears.

Returning to FIGS. 2 and 3, linked ammunition 44 is fed into gun 30 onto feed tray 201 by front and rear feed sprockets 202 and 204, respectively, which are both secured to feed sprocket shaft 206. Feed sprockets 202 and 204 each have five teeth in the preferred embodiment. These teeth on sprockets 202 and 204 engage ammunition rounds 44 of the linked ammunition belt. As sprockets 202 and 204 rotate, they feed a new round of ammunition into a round extractor, in a manner to be described below. Five rounds of ammunition are fed for each rotation of feed sprocket shaft 206; thus, feed sprocket shaft rotates 72 degrees for each round of ammunition fed into gun 30. The rearmost end of feed sprocket shaft 206 is coupled to a first bevel gear 208, which is engaged with, and driven by, a second bevel gear 210. Bevel gear 210 is attached to the upper end of vertical shaft 212; as shown in FIG. 3, the lower end of vertical shaft 212 is attached to a belt feed geneva wheel 214. Belt feed geneva wheel 214 is rotated intermittently, in a manner to be described below, to periodically rotate shaft 212, which in turn rotates feed sprocket shaft 206 to feed rounds of ammunition. The gear ratio of first bevel gear 208 and second bevel gear 210 is selected such that 90 degrees of rotation of vertical shaft 212 results in 72 degrees of rotation of feed sprocket shaft 206.

Still referring to FIGS. 2 and 3, a rotatable round positioner assembly 220 includes a round guide 222, an ejector guide 224, and a bolt feed rotor 226. Bolt feed rotor 226 functions to receive extracted rounds of ammunition 44, and to rotate the extracted round into a lowermost position of round guide 222, for allowing a bolt carrier to push the extracted round into a breech of the gun. Bolt feed rotor 226 also serves to transport a fired round of ammunition from the lowermost position of round guide 222 to an ejection port 228 of ejector guide 224 for ejecting spent rounds of ammunition. Bolt feed rotor 226 is secured to the forward-most end of bolt feed rotor shaft 230. The opposing end of bolt feed rotor shaft 230 is coupled to bevel gear 232; the gear teeth of bevel gear 232 mates with gear teeth of bevel gear 234 mounted on the upper end of a stub shaft 236. The lower end of stub shaft 236 has a conventional circular gear 238 secured thereto. In turn, the teeth of circular gear 238 mesh with the teeth of circular gear 240, which is mounted to the upper end of a bolt feed spur shaft 242. The lower end of bolt feed spur shaft 242 is secured to the center of round positioning geneva wheel 244, which is periodically rotated through 90 degree angle increments, in a manner to be described below.

Thus, as round positioning geneva wheel 244 is rotated, in a manner to be described below, spur shaft 242 and gear 240 are also rotated, causing circular gear 238 and bevel gear 234 to rotate; in turn, bevel gear 232, bolt feed rotor shaft 230, and bolt feed rotor 226 are rotated thereby. Bolt feed rotor 226, bolt feed rotor shaft 230, and bevel gear 232 rotate through an angle of 180 degrees for every ammunition round fired. However, round positioning geneva wheel 244 rotates only 90 degrees for every ammunition round fired. Accordingly, the gear ratios for bevel gears 232 and 234, and for circular gears 238 and 240, are selected such that 90 degrees of rotation of round positioning geneva wheel 244 produces 180 degrees of rotation of bolt feed rotor 226 (an overall ratio of 2:1).

As mentioned above, motor 38 rotates chain drive loop 200. One of the functions of chain drive loop 200 is to reciprocate a movable bolt carrier assembly 250. Bolt carrier assembly 250 includes front and rear circular collars 254 for slidably engaging guide tube 256. The rear portion of bolt carrier assembly 250 includes a downwardly facing channel, or slider track, 258 which extends laterally across the underside of bolt carrier assembly 250. Slider track 258 is engaged with a raised cam 402 (see FIG. 4) that is pivotally connected to the top of chain drive loop 200, and which rotates about dogbone track 400 along with chain drive loop 200. Raised cam 402 rotates freely upon axle 404. As chain drive loop 200 rotates about its dogbone track 400, raised cam 402 moves laterally back and forth within slider track 258 of bolt carrier assembly 250. When chain drive loop 200 moves raised cam 402 rearwardly, bolt carrier assembly 250 also slides rearwardly; likewise, when chain drive loop 200 moves raised cam 402 forwardly, bolt carrier assembly 250 also moves forwardly. Raised cam 402 is always contained within slider track 258 but is free to move laterally therein.

There are three important components that are secured to, and travel with, bolt carrier assembly 250. First, round extractor 270 is secured at its rear end to bolt carrier assembly 250, and slides forwardly and backwardly along with bolt carrier assembly 250. Round extractor 270 extends forwardly from its rear end to a claw-shaped de-linker/extractor 272 at its opposing forward end. When bolt carrier assembly 250 slides to its forwardmost position, front and rear feed sprockets 202 and 204 of feed sprocket shaft 206 feed a new round of ammunition 44 into claw 272. When bolt carrier assembly 250 slides back to its rearmost position, the extracted round of ammunition 44 grasped by claw 272 is stripped rearwardly out of the linked ammunition belt, and retracted into bolt feed rotor 226.

Second, bolt carrier 600 and associated breech bolt 602 (see FIG. 11) extend forwardly from bolt carrier assembly 250. The forward end of breech bolt 602 releasably grasps the shell of ammunition round 44 and, as bolt carrier assembly 250 slides forward, breech bolt 602 delivers ammunition round 44 into breech 280 (see FIGS. 2 and 3) for firing. Breech 280 is adapted to receive a round of ammunition to be fired, and is supported by a pair of recoil sleeves 282 and 284 on opposing sides thereof. After ammunition round 44 is fired, bolt carrier assembly 250 returns rearward, retracting the expended shell of ammunition round 44 out of breech 280 and back into bolt feed rotor 226 for eventual rotation to an ejection position. Thus, bolt carrier assembly 250, including bolt carrier 600 and breech bolt 602, slide alternately toward and away from breech 280, moving through one such reciprocating cycle for each 360 degrees of rotation of chain drive loop 200.

Third, ejector rod 604 extends forwardly from bolt carrier assembly 250. As bolt carrier assembly 250 slides forward, the forward end of ejector rod 604 pushes the expended shell of ammunition round 44 out of ejector guide 224, and out of gun 30 through ejection hole 46.

Figure 7:
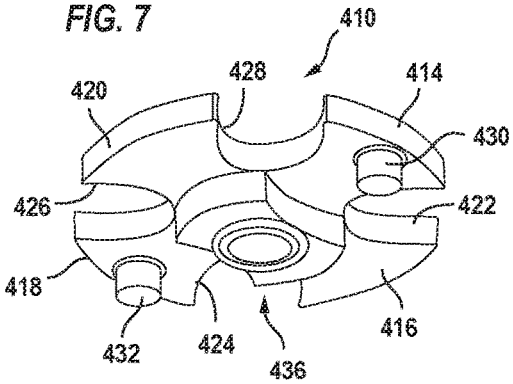
FIG. 7 is a lower perspective view of the main geneva wheel.

Returning to FIG. 4, arrow 450 indicates the direction in which chain drive loop 200 rotates when motor 38 is operated. Belt feed geneva wheel 214 and round positioning geneva wheel 244 are shown being rotatably mounted near chain drive loop 200, and just below a main geneva wheel 410. Main geneva wheel 410 is mounted for rotation about its central axle 412 adjacent chain drive loop 200 and is periodically rotated by chain drive loop 200 in a manner now to be described. In the preferred embodiment, and as shown best in FIG. 7, main geneva wheel 410 includes four lobes 414, 416, 418 and 420 spaced at 90 degree intervals. Four semi-circular slots, or pockets, 422, 424, 426 and 428 are formed in main geneva wheel 410 between its four lobes. In addition, a pair of downwardly-directed pins 430 and 432 extend from the undersides of opposing lobes 414 and 418 separated by an angle of 180 degrees from each other.

Preferably, the underside of main geneva wheel 410 further includes a projecting plateau 436 having two convex shoulders spaced 180 degrees apart from each other, and separated by two opposing concave arcuate cut-outs. As shown in the bottom view of FIG. 10, the perimeter of projecting plateau 436 is in close proximity to the outer perimeter of belt feed geneva wheel 214 and round positioning geneva wheel 244. Plateau 436 is also known in the art as a "locking ring" because it can serve to lock a driven wheel in place until a time when the driven wheel should rotate. In the particular position shown in FIG. 10, plateau 436 resists movement by either belt feed geneva wheel 214 or round positioning geneva wheel 244. However, as main geneva wheel is rotated 30 to 40 degrees clockwise (relative to FIG. 10) from the original position shown in FIG. 10, plateau 436 disengages from the perimeter of belt feed geneva wheel 214, permitting rotation thereof, while continuing to oppose rotation of round positioning geneva wheel 244. This remains the case until main geneva wheel 410 has rotated a full 90 degrees, at which time plateau 436 does not resist movement by either belt feed geneva wheel 214 or round positioning geneva wheel 244. As main geneva wheel 410 continues to rotate clockwise (relative to FIG. 10) plateau 436 re-engages the perimeter of belt feed geneva wheel 214 to resist further movement thereof, but moves out of engagement with round positioning geneva wheel 244, thereby allowing round positioning geneva wheel 244 to be rotated.

Figure 8:
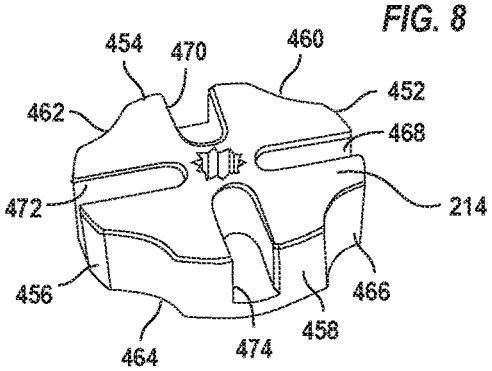
FIG. 8 is an upper perspective view of the belt feeding geneva wheel.
Figure 10:
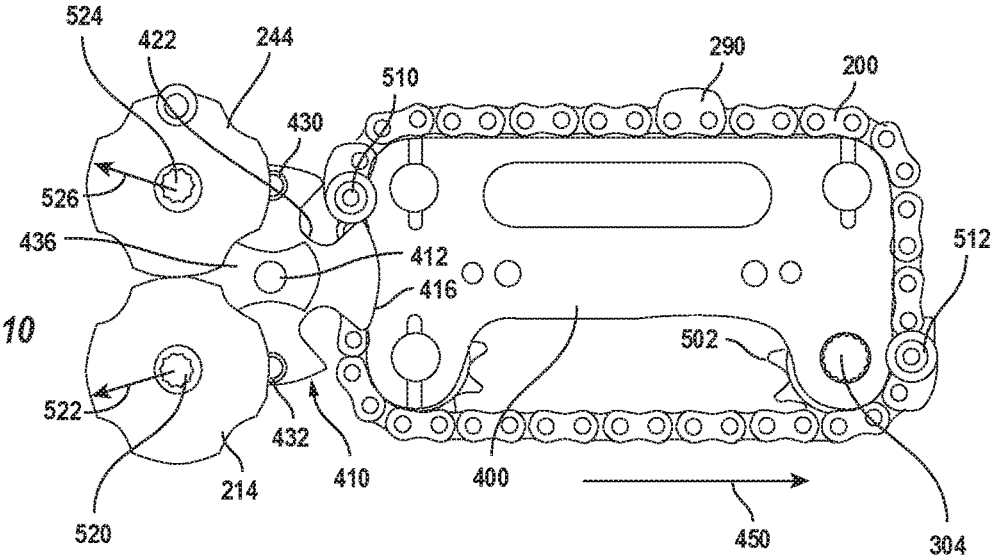
FIG. 10 is a bottom view of the chain drive, main geneva wheel, belt feeding geneva wheel, and round positioning geneva wheel shown in FIG. 9.

FIG. 8 is a close-up view of belt feed geneva wheel 214, though round positioning geneva wheel 244 is formed in the same configuration. Belt feed geneva wheel 214 has four convex arcuate portions 452, 454, 456 and 458 spaced at 90 degree intervals, and separated from each other by four concave portions 460, 462, 464, and 468. As shown in FIG. 10, these concave portions are periodically positioned adjacent to the convex projections extending from plateau 436 of main geneva wheel 410.

Figure 9:
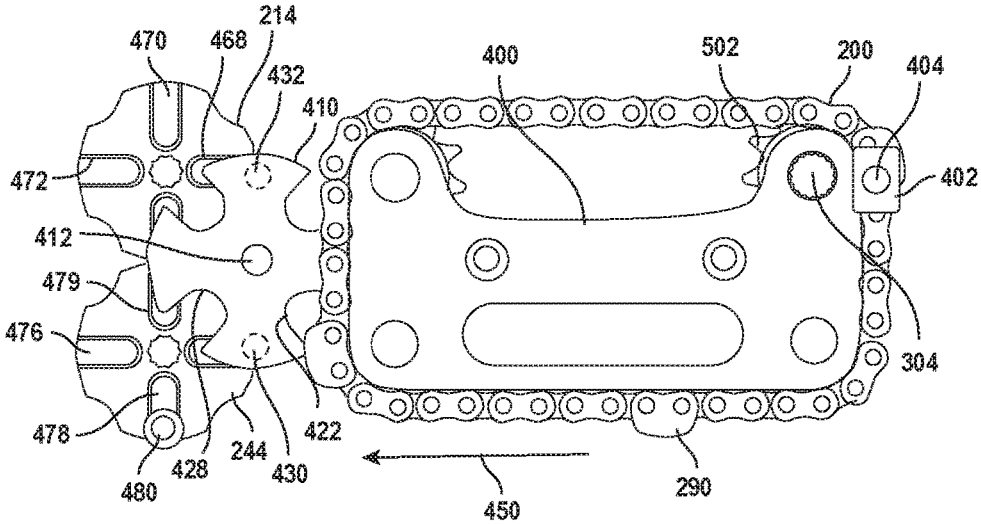
FIG. 9 is a top view of the chain drive, main geneva wheel, belt feeding geneva wheel, and round positioning geneva wheel.

As shown in FIG. 8, radial slots are formed in each of the four convex portions, including radial slots 468, 470, 472 and 474. Each such radial slot is adapted to be engaged by one of the pins 430 and 432 (see FIGS. 7 and 10) that extend downwardly from main geneva wheel 410 for being rotated thereby. Referring briefly to FIGS. 4 and 9, it will be noted that round positioning geneva wheel 244 is of the same construction as belt feed geneva wheel 214, and likewise includes four radial slots, including radial slots 476 and 478. The radial slots formed in round positioning geneva wheel 244 are similarly adapted to be engaged by one of the pins 430 and 432 (see FIGS. 7 and 10) that extend downwardly from main geneva wheel 410 for being rotated thereby. Also indicated in FIGS. 4 and 9 is a spring-biased detent 480 positioned adjacent round positioning geneva wheel 244, although it may instead be positioned adjacent belt feed geneva wheel 214, if desired. Detent 480 yieldingly engages one of the radial slots of round positioning geneva wheel 244 to temporarily maintain round positioning geneva wheel 244 fixed at one of its four 90-degree orientations until one of pins 430 or 432 forcibly rotates round positioning geneva wheel 244 away from its current 90-degree orientation.

As shown best in FIGS. 6 and 10, chain drive loop 200 includes at least a first drive link roller 510 and a second drive link roller 512, each preferably formed of hardened steel. Drive link rollers 510 and 512 are each coupled to chain drive loop 200 and rotate therewith. Each of drive link rollers 510 and 512 is pivotally supported upon a downwardly extending axle. The purpose of drive link rollers 510 and 512 is to periodically engage, and partially rotate, main geneva wheel 410 in a timed manner for alternately rotating belt feed geneva wheel 214 and round positioning geneva wheel 244. For example, drive link roller 510 is adapted to engage semi-circular pockets 422 and 426 of main geneva wheel 410, while drive link roller 512 is adapted to engage semi-circular pockets 424 and 428 of main geneva wheel 410. To maximize the life and durability of gun 30, drive link rollers 510 and 512, main geneva wheel 410, belt feed geneva wheel 214, and round positioning geneva wheel 244 are all preferably made from hardened steel.

Drive link rollers 510 and 512 are spaced apart from each other along chain drive loop 200; the distance separating drive link rollers 510 and 512 is set to properly sequence the relative rotation of belt feed geneva wheel 214 and round positioning geneva wheel 244, and hence, the rotation of feed sprocket shaft 206 relative to the rotation of bolt feed rotor shaft 230. These operations are, in turn, synchronized with reciprocating movement of bolt carrier assembly 250 as chain drive loop 200 rotates about its track 400. For each 360 degree rotation of chain drive loop 200, belt feed geneva wheel 214 and it associated vertical shaft 212 are rotated by 90 degrees, and belt feed sprockets 202 and 204 are rotated through an angle of 72 degrees to feed one round of ammunition into round extractor 270. Also, for each 360 degree rotation of chain drive loop 200, round positioner geneva wheel 244 is rotated by 90 degrees, resulting in rotation of bolt feed rotor shaft 230 through an angle of 180 degrees.

Referring to FIGS. 4, 9 and 10, drive link roller 510 is shown as it is about to enter pocket 422 of main geneva wheel 410. Drive link roller 510 will cause main geneva wheel 410 to rotate by 90 degrees before drive link roller 510 exits from pocket 422. During that 90 degree angular rotation of main geneva wheel 410, pin 432, which extends from main geneva wheel 410, engages radial slot 468 of belt feed geneva wheel 214, and causes belt feed geneva wheel 214 to rotate by 90 degrees, while round positioning geneva wheel 244 remains stationary. Belt feed geneva wheel 214 is rotated in an accelerated fashion, i.e., belt feed geneva wheel 214 starts and stops its partial rotation more quickly than does main geneva wheel 410. As drive link roller 510 exits from pocket 422 of main geneva wheel 410, pin 432 is temporarily positioned midway between the respective axles of belt feed geneva wheel 214 and round positioning geneva wheel 244, just between aligned radial slots 468 and 479 of belt feed geneva wheel 214 and round positioning geneva wheel 244, respectively.

All three geneva wheels 410, 214 and 244 maintain such angular positions until the second drive link roller 512 approaches main geneva wheel 410. At that time, drive link roller 512 engages the next succeeding pocket 428 of main geneva wheel 410 for rotating pin 432 fully out of radial slot 468 and into radial slot 479. As drivel link roller 512 continues to sweep across, main geneva wheel 410, and its pin 432, are caused to rotate through a second angular rotation of 90 degrees. Pin 432 bears upon radial slot 479, overcomes the biasing force of detent 480, and rotates round positioning geneva wheel 244 by 90 degrees, while belt feed geneva wheel 214 remains stationary. Once again, round positioning geneva wheel 244 is rotated in an accelerated fashion, i.e., round positioning geneva wheel 244 starts and stops its partial rotation more quickly than does main geneva wheel 410.

Thus, for each full rotation of chain drive loop 200 about its dogbone track 400, the first drive link roller 510 rotates main geneva wheel 410 through a first angular rotation of 90 degrees over a first period of time, and the second drive link roller 512 rotates main geneva wheel 410 through a second angular rotation of 90 degrees over a second period of time. During the first such period of time, main geneva wheel 410 rotates belt feed geneva wheel 214 by 90 degrees, and during the second period of time, main geneva wheel 410 rotates round positioning geneva wheel 244 by 90 degrees.

As shown best in FIGS. 9 and 10, the preferred embodiment of the invention positions belt feed geneva wheel 214 closely proximate to round positioning geneva wheel 244. In this manner, each of pins 430 and 432 of main geneva wheel 410 can exit a slot of belt feed geneva wheel 214 and pass smoothly into an aligned slot of round positioning geneva wheel 244. In FIG. 10, belt feed geneva wheel 214 is shown rotating about axle 520, and has an outermost radius R1 indicated by arrow 522. Round positioning geneva wheel 244 is shown rotating about axle 524, and has an outermost radius R2 indicated by arrow 526. Preferably, second radius 526 (R2) is substantially equal to first radius 522 (R1). In addition, axle 520 is spaced apart from axle 524 by a distance that is just greater than, but approximately equal to, the sum of first radius 522 (R1) plus second radius 526 (R2). Main geneva wheel 410 has a rotation axle 412, and axle 520 of belt feed geneva wheel 214 and axle 524 of round positioning geneva wheel 244 are preferably equidistant from axle 412 of main geneva wheel 410.

Figure 12:
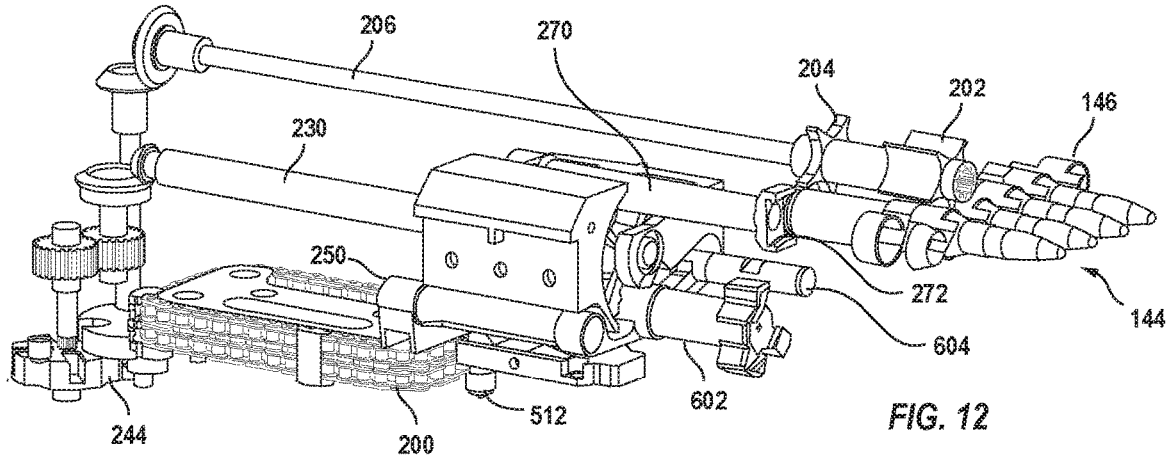
Figure 13:
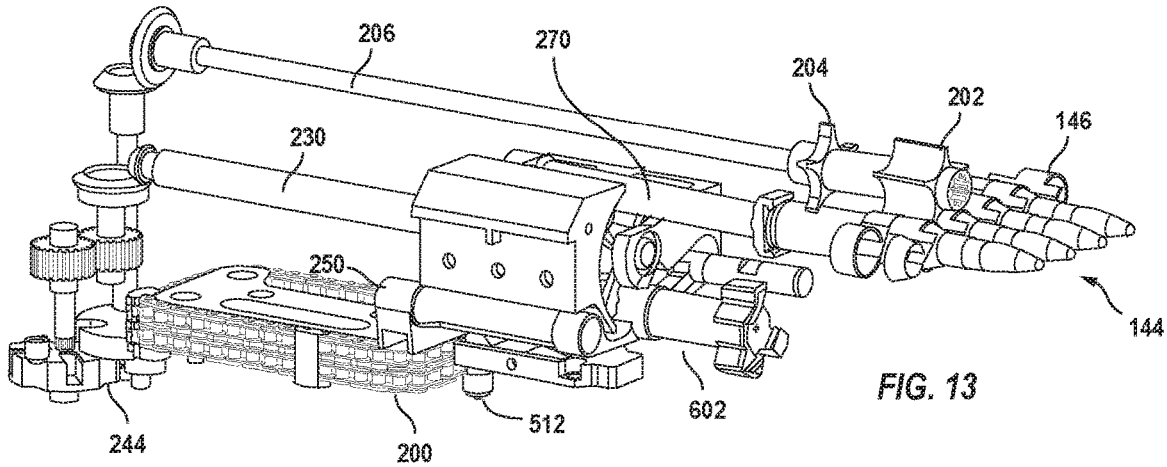

FIGS. 11-22 show selected components of gun 30 during succeeding phases of operation. In FIG. 11, bolt carrier assembly 250 is shown in its forward position in preparation for feeding a next ammunition round 44 into round extractor 270. In FIG. 11, no prior rounds of ammunition are contained within gun 30, so breech bolt 602 is empty. In FIG. 12, bolt carrier assembly 250 is still in its forward position, but feed sprockets 202 and 204 have been rotated to begin feeding a new ammunition round 44 into the clawed end of round extractor 270. In FIG. 13, bolt carrier assembly 250 is still in its forward position, and feed sprockets 202 and 204 have been further rotated; new ammunition round 44 is now fully engaged with the clawed end of round extractor 270.

Figure 14:
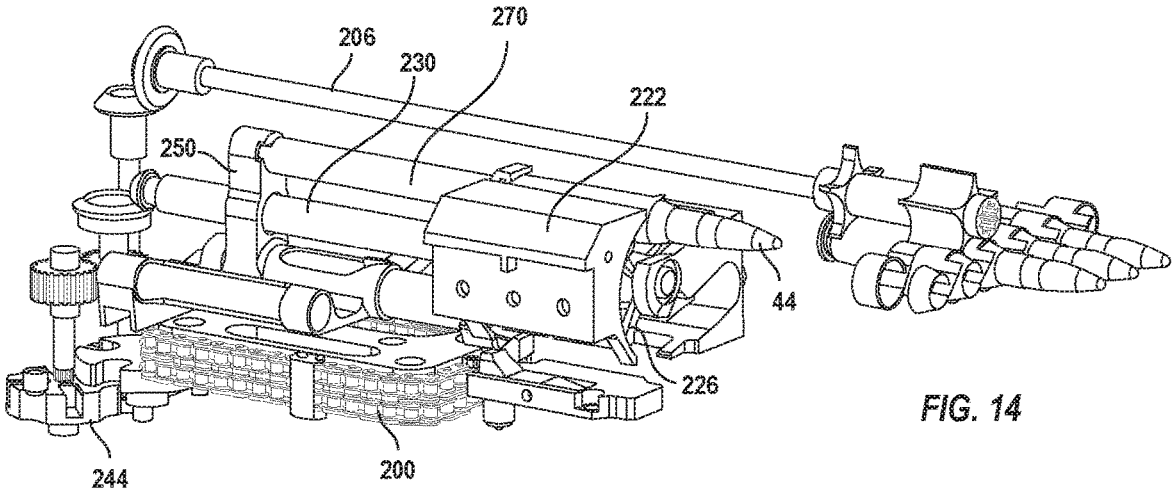

FIG. 14 shows bolt carrier assembly 250 having been retracted to its rearmost position. Ammunition round 44 has been stripped from linked ammunition belt 144, and is now positioned within bolt feed rotor 226 in the upper portion thereof, still engaged by the clawed end of round extractor 270; as shown in FIG. 14, ammunition round 44 is in the 12 o'clock position within round guide 222. It will be noted that the rearward force to strip ammunition round 44 from ammunition belt 144 is supplied by round extractor 270, which is part of bolt carrier assembly 250, and which, in turn, is reciprocated by chain drive loop 200, under the power of electric motor 38; thus, sufficient force is supplied to round extractor 270 to efficiently strip round 44 from ammunition belt 144.

Figure 15:
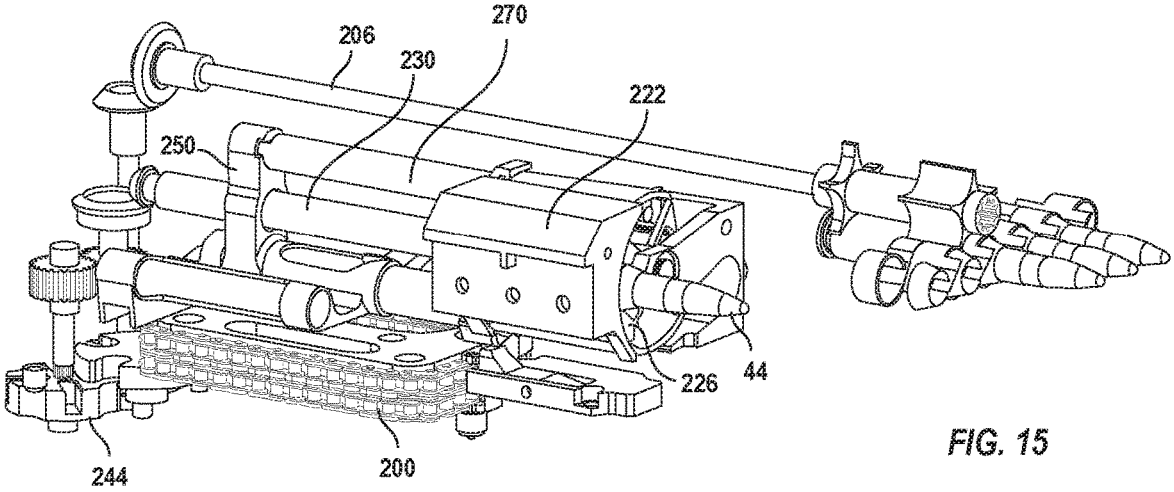

In FIG. 15, bolt carrier assembly 250 is still in its rearmost position, but now bolt feed rotor shaft 230 has rotated 90 degrees, pulling ammunition round 44 out of the clawed end of round extractor 270, and moving ammunition round 44 partially along round guide 222 to the 9 o'clock position.

Figure 16:
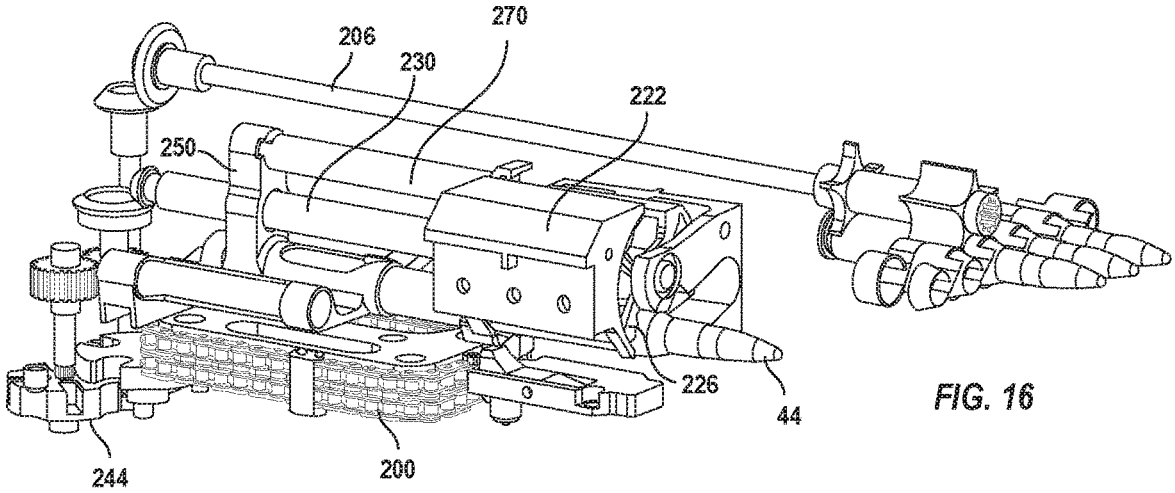

In FIG. 16, bolt carrier assembly 250 is still in its rearmost position, but now bolt feed rotor shaft 230 has rotated another 90 degrees, moving ammunition round 44 to the 6 o'clock, lowermost portion of round guide 222, co-axial with breech 280 and barrel 32 of gun 30.

Figure 17:
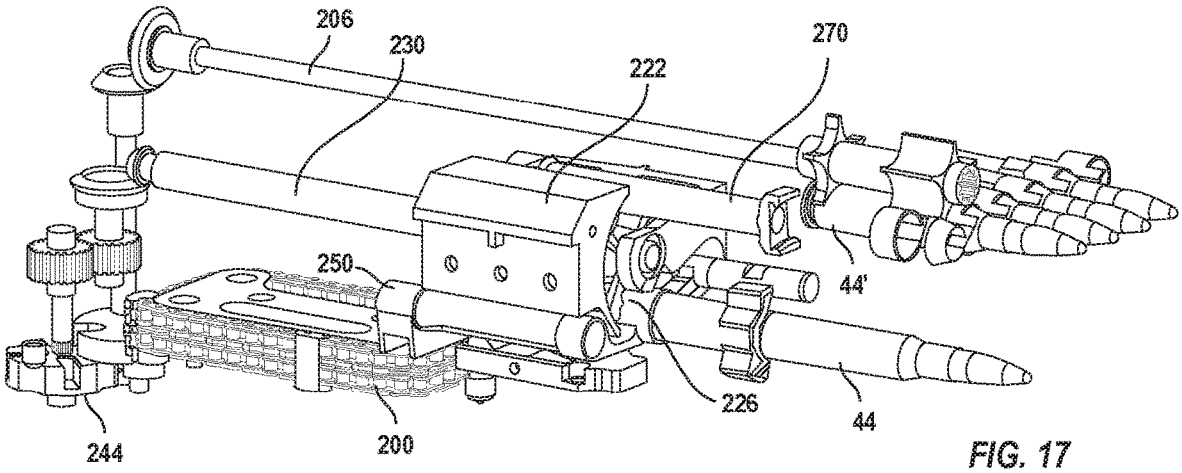

In FIG. 17, bolt carrier assembly 250 has returned to its forward position. Ammunition round 44, now grasped by breech bolt 602, is advanced forward for delivery into breech 280. It will be noted that gun 30 has now moved through one full cycle as compared to the starting position shown in FIG. 11. First ammunition round 44 is ready to be fired, and round extractor is ready to receive the next round of ammunition 44'.

Figure 18:
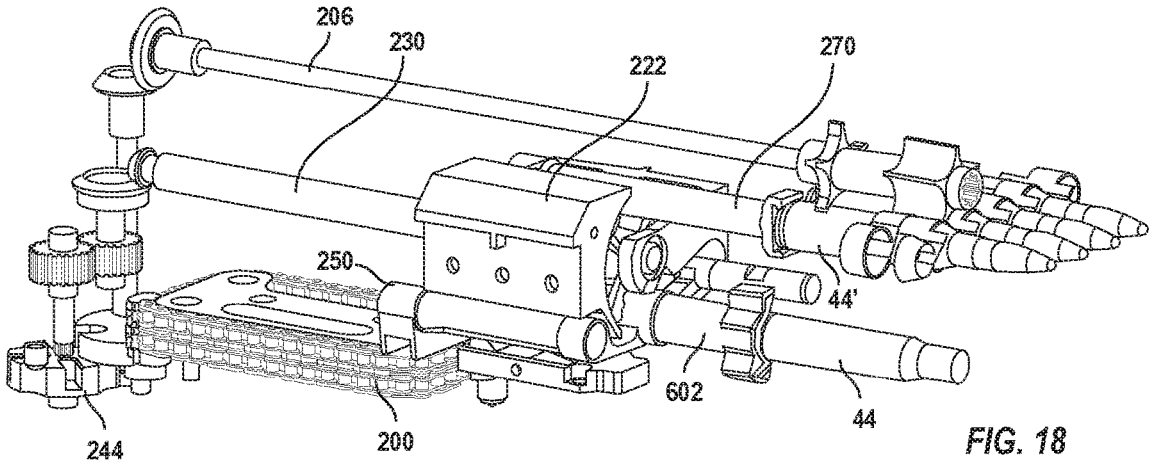

Next, in FIG. 18, the first round 44 has been fired, leaving its expended shell still held by breech bolt 602. Next round 44' has been fully engaged by round extractor 270. It will be noted that FIG. 18 corresponds to earlier FIG. 13, except that breech bolt 602 now holds an expended shell.

Figure 19:
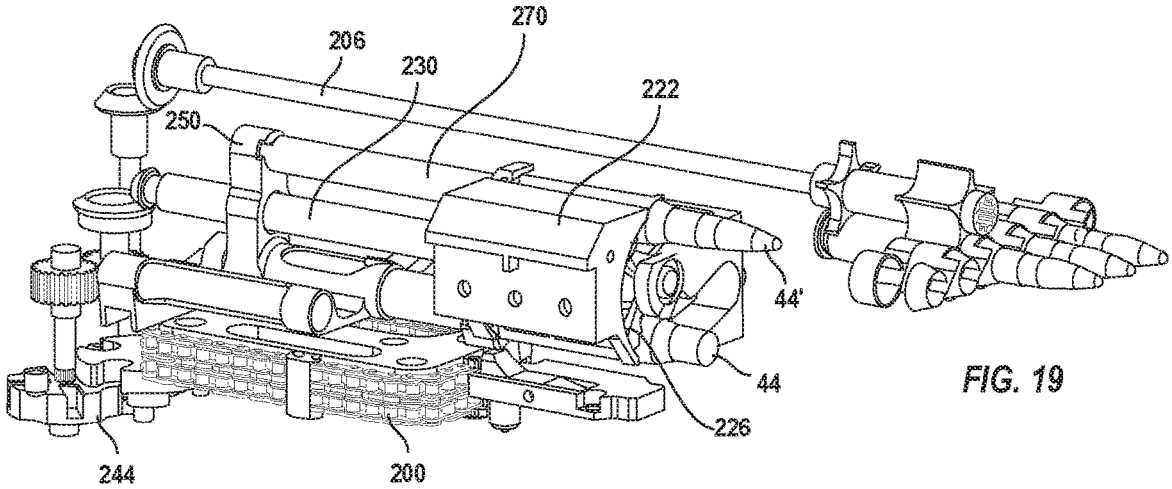

In FIG. 19, which corresponds to earlier FIG. 14, bolt carrier assembly 250 has returned to its rearmost position. Second round 44' has been stripped from the linked ammunition belt and retracted into bolt feed rotor 226 at the 12 o'clock position; expended shell 44 has been retracted into the lowermost portion of bolt feed rotor 226 at the 6 o'clock position.

Figure 20:
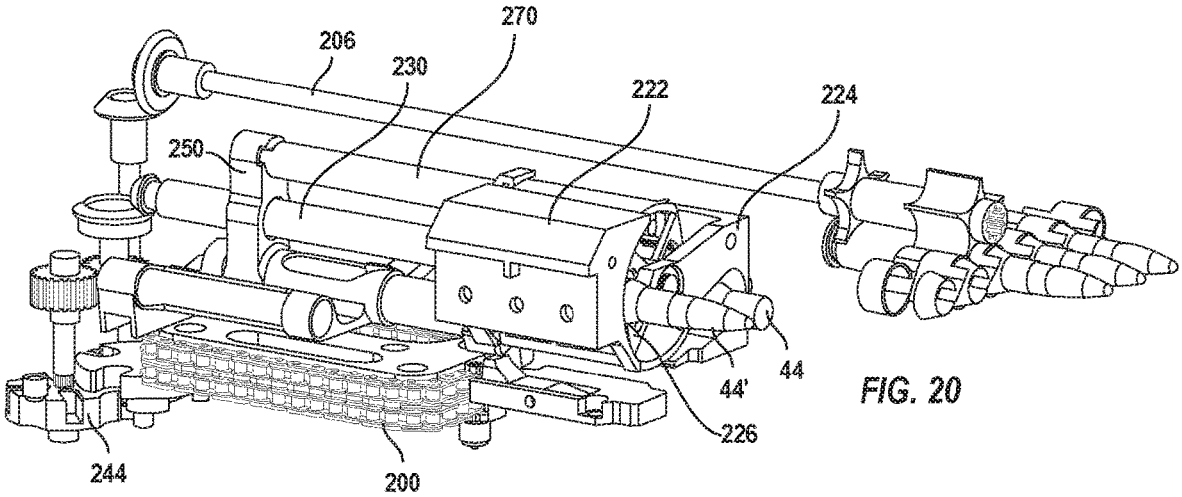

In FIG. 20, which corresponds to earlier FIG. 15, bolt carrier assembly 250 is still in its rearmost position, but bolt feed rotor 226 has been rotated by 90 degrees, stripping new round 44' from round extractor 270, and moving it to the 9 o'clock position. Bolt feed rotor 226 has also moved expended round 44 into ejector guide 224.

Figure 21:
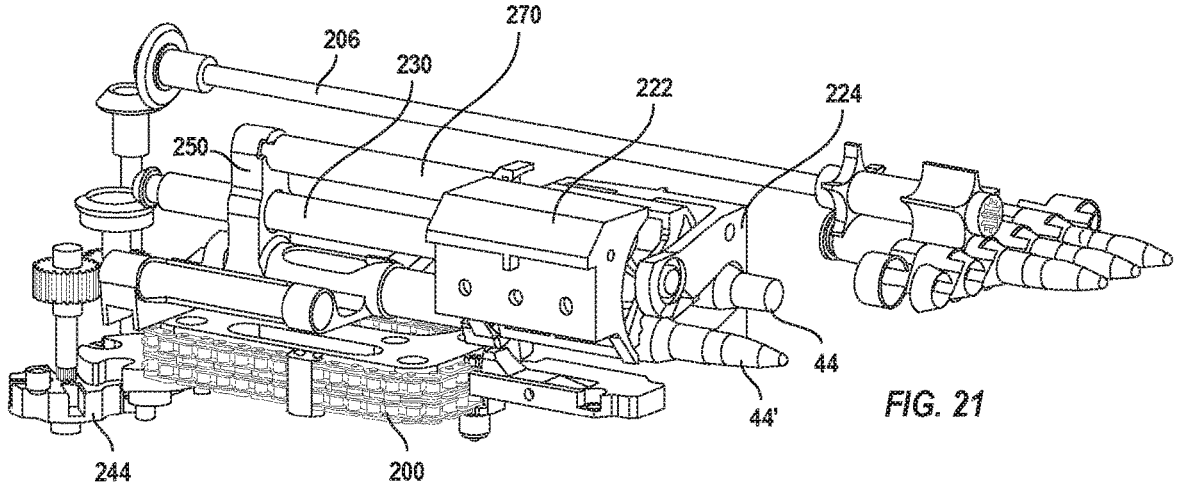

In FIG. 21, which corresponds to earlier FIG. 16, bolt carrier assembly 250 is still in its rearmost position. However, bolt feed rotor 226 has been rotated by another 90 degrees, moving next round 44' to the 6 o'clock, lowermost portion of round guide 222, co-axial with breech 280 and barrel 32 of gun 30. Expended round 44 is still held in ejector guide 224.

Figure 22:
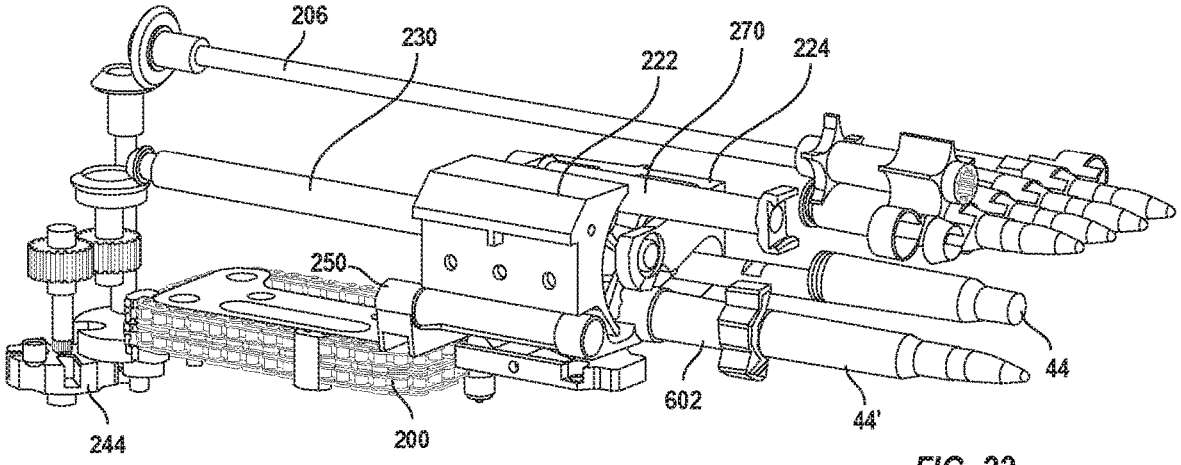

Finally, in FIG. 22, which corresponds to earlier FIG. 17, bolt carrier assembly 250 has been moved to its forwardmost position, and next round 44' is pushed by breech bolt 602 into breech 280 of gun 30 for firing. Round extractor 270 has moved forward in preparation for receiving a third ammunition round. In addition, ejector rod 604 has moved forward to push expended round 44 out of ejector guide 224, and out of gun 30 through ejection holes 228 (see FIGS. 2) and 46 (see FIG. 1).

Those skilled in the art will appreciate that, not only has a novel gun apparatus been disclosed herein, but also a novel method of operating such a gun. In practicing such method, chain drive loop 200 is rotated about track 400. First drive link 510 is secured to chain drive loop 200, and second drive link 512 is also secured to chain drive loop 200, spaced apart from first drive link 510. Main geneva wheel 410 is mounted for rotation proximate to chain drive loop 200, whereby first drive link 510 and second drive link 512 periodically travel past main geneva wheel 410 as chain drive loop 200 is rotated. Main geneva wheel 410 is rotated through a first partial rotation as first drive link 510 travels past main geneva wheel 410, and again rotated through a second partial rotation as second drive link 512 travels past main geneva wheel 410.

In accordance with at least some embodiments of such method, belt feed geneva wheel 214 is mounted for rotation proximate to main geneva wheel 410 for being periodically rotated thereby. Belt feed geneva wheel 214 is coupled to a rotating belt feeder, e.g., sprockets 202/204 for periodically feeding a round of ammunition into round extractor 270. After extracting the round, round extractor 270 transfers the extracted round to rotatable bolt feed rotor 226. In addition, round positioning geneva wheel 244 is mounted for rotation proximate to main geneva wheel 410 for being periodically rotated thereby; round positioning geneva wheel 244 is coupled with bolt feed rotor 226 for moving an extracted round of ammunition into alignment with the breech and barrel of the gun for firing.

In practicing such method, drive links 510 and 512 preferably include rollers for engaging pockets formed within main geneva wheel 410. First roller 510 engages one of such pockets as the chain drive loop 200 rotates past main geneva wheel 410. Likewise, second roller 512 engages one of such pockets as chain drive loop 200 rotates past main geneva wheel 410. In this embodiment of such method, first roller 510 is used to rotate main geneva wheel 410 through a first angular rotation of 90 degrees during a first period of time, and second roller 512 is used to rotate main geneva wheel 410 through a second angular rotation of 90 degrees during a second period of time. Main geneva wheel 410 rotates belt feed geneva wheel 214 by 90 degrees during the first period of time. Then, main geneva wheel 410 rotates round positioner geneva wheel 244 by 90 degrees during the second period of time.

At least some embodiments of such method include providing opposing first and second pins 230 and 232 on main geneva wheel 410, providing radial slots (468, 470, 472, 474) in belt feed geneva wheel 214, and providing radial slots (476, 478, 479) in the round positioning geneva wheel. In practicing this embodiment of such method, one of the first and second pins (230, 232) of main geneva wheel 410 is periodically engaged with one of the radial slots in belt feed geneva wheel 214 to rotate it through a partial rotation. Similarly, one of the first and second pins (230, 232) of main geneva wheel 410 is periodically engaged with one of the radial slots in round positioning geneva wheel 244 to rotate it through a partial rotation. In this embodiment of such method, belt feed geneva wheel 214 is positioned in close proximity to round positioning geneva wheel 244 whereby each of the first and second pins (230, 232) of the main geneva wheel can enter a radial slot of round positioning geneva wheel 244 substantially immediately after exiting from a radial slot of belt feed geneva wheel 214.

Those skilled in the art will appreciate that the components described herein to feed, strip, and position ammunition rounds can be scaled up or down to accommodate a wide range of ammunition rounds, ranging between 7.62 mm rounds up to 50 mm rounds. Firing rates can be as high as one-thousand rounds of ammunition per minute. It will also be appreciated that, while only one main geneva wheel, and only two secondary belt feed and round positioning geneva wheels, have been shown and described, two or more sets of such geneva wheels could be provided along different portions of the chain drive to synchronize the intermittent rotation of a larger number of drive shafts, if desired; i.e., a second main geneva wheel, and two further driven wheels, could be added, if desired. The second main geneva wheel would be controlled by the same chain drive loop (200), and could be rotated by the same drive links (510, 512) used to rotate the first main geneva wheel, or by their own dedicated drive links secured to the same chain drive loop (200).

The detailed description of the illustrated embodiments above has been applied to linked ammunition, i.e., rounds of ammunition linked together to form belts. Those skilled in the art are also familiar with ammunition round supply systems wherein un-linked rounds of ammunition are stored in a magazine or like container, and are presented in consecutive serial fashion to the feed inlet of a gun. The present invention may be advantageously practiced with a gun adapted to receive un-linked rounds of ammunition. Such un-linked ammunition feed systems are generally disclosed in U.S. Pat. No. 3,747,469 to Ashley, et al.; U.S. Pat. No. 4,781,100 to Baldwin; U.S. Pat. No. 4,833,966 to Maher, et al.; U.S. Pat. No. 5,218,162 to Bender-Zanoni; and U.S. Pat. No. 5,458,044 to Delbos. The linkless gun transfer unit disclosed in Baldwin U.S. Pat. No. 4,781,100 is particularly adapted to feed ammunition rounds into the gun already described above, and the disclosure of U.S. Pat. No. 4,781,100 to Baldwin is hereby incorporated by reference as if fully set forth herein.

In adapting the gun already described above for use with un-linked ammunition rounds, the component previously described as belt feed geneva wheel 214 still functions in the same manner, but would more properly be identified as a round feed geneva wheel, since it controls the advancement of individual un-linked rounds. Although ammunition rounds no longer need to be extracted, or "stripped", from the links of an ammunition belt, such rounds still need to be retracted for delivery to bolt feed rotor 226. Thus, the component previously described as round extractor 270 now serves as a round retractor for securing and retracting fresh rounds. Otherwise, the gun for firing un-linked rounds still includes a chain drive loop 200 supported for rotation about track 400, as well as motor 38 coupled to the chain drive loop 200 for rotating the chain drive around the track. The main geneva wheel 410 is still mounted for rotation proximate to the chain drive loop 200 for being periodically rotated thereby. As before, the round feed (formerly, belt fee) geneva wheel 214, and round positioning geneva wheel 244, are still mounted for rotation proximate to the main geneva wheel 410 for being periodically rotated thereby. A rotatable round feeder (202, 204) still engages fresh rounds of ammunition and feeds them to the round retractor (270); the round feeder (202, 204) is still coupled to the round feed geneva wheel (214) and is periodically rotated thereby. A rotatable round positioner assembly 220 still receives a round of ammunition from the round retractor 270 and rotates the round of ammunition to a firing position; the round positioner 220 is still coupled to the round positioning geneva wheel 244 for being periodically rotated thereby.

Similarly, while the method of the present invention has been described above in regard to belted, or linked, ammunition rounds, the present invention also encompasses a method of feeding of rounds of un-linked ammunition to a gun and positioning rounds for firing within the gun. In practicing such method, chain drive loop 200 is selectively rotated about track 400; first and second drive links (510, 512) are still secured to chain drive loop 200, spaced apart from each other. Main geneva wheel 410 is mounted for rotation proximate chain drive loop 200, whereby first and second drive links (510, 512) periodically travel past main geneva wheel 410. Main geneva wheel 410 is rotated through a first partial rotation as the first drive link travels past it, and is rotated through a second partial rotation as the second drive link travels past it. A round feed geneva wheel (214) is rotatably mounted proximate to main geneva wheel 410 for being periodically rotated thereby.

Round retractor 270 is also provided for engaging and retracting rounds of ammunition. Round feed geneva wheel (214) is coupled to rotating round feeder (202, 204) for periodically feeding a round of ammunition into round retractor 270. A rotatable bolt feed rotor (226) is provided, and a retracted round of ammunition is transferred from the round retractor 270 to the bolt feed rotor 226. A round positioning geneva wheel (244) is rotatably mounted proximate to main geneva wheel 410 for being periodically rotated thereby. Round positioning geneva wheel 244 is coupled with bolt feed rotor 226 to move a retracted round of ammunition into alignment with the barrel of the gun.

Those skilled in the art will now appreciate that a simple, durable, and relatively inexpensive weapon has been described for firing rounds from a linked ammunition belt wherein the feeding of ammunition into the gun, de-linking and extraction of rounds from the ammunition belt, and positioning of extracted rounds in a firing position, can all be directly synchronized by a relatively simple geneva wheel apparatus. The steps of feeding of ammunition into the weapon, de-linking and extracting rounds from the ammunition belt, and positioning of extracted rounds in a firing position, can be positively maintained in synchronization without significant loss of power. While the aforementioned feeding, de-linking, extraction and positioning operations are each intermittent operation in nature, the present invention easily, and directly, coordinates such operations with each other. The same basic configuration described herein can be used to feed, de-link, extract, and position a wide variety of different types and sizes of ammunition rounds, while providing relatively rapid firing rates as high as 1,000 rounds per minute. It will also be appreciated by those skilled in the art that a related method has also been disclosed for operating such a weapon.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A method of feeding of rounds of ammunition from an ammunition belt to a gun and positioning rounds for firing within the gun, the gun having a barrel for guiding fired rounds, the method including the steps of:

selectively rotating a chain drive about a track;

mounting a main geneva wheel for rotation proximate to the chain drive;

rotating the main geneva wheel through a first partial rotation, and through a second partial rotation, for each rotation of the chain drive about the track;

mounting a belt feed geneva wheel for rotation proximate to the main geneva wheel for being periodically rotated thereby;

providing a round extractor for engaging and extracting rounds of ammunition;

coupling the belt feed geneva wheel to a rotating belt feeder for periodically feeding a round of ammunition into the round extractor;

providing a rotatable bolt feed rotor;

transferring an extracted round of ammunition from the round extractor to the bolt feed rotor;

mounting a round positioning geneva wheel for rotation proximate to the main geneva wheel for being periodically rotated thereby; and coupling the round positioning geneva wheel with the bolt feed rotor to move an extracted round of ammunition into alignment with the barrel of the gun.

2. The method recited by claim 1 including the further steps of:

securing a first drive link to the chain drive, and causing the first drive link to periodically travel past the main geneva wheel as the chain drive is rotated;

securing at least a second drive link to the chain drive spaced apart from the first drive link, and causing the second drive link to periodically travel past the main geneva wheel as the chain drive is rotated;

rotating the main geneva wheel through the first partial rotation as the first drive link travels past the main geneva wheel; and;

rotating the main geneva wheel through the second partial rotation as the second drive link travels past the main geneva wheel.

3. The method recited by claim 2 including the further steps of:

providing the first drive link with a first roller;

providing the second drive link with a second roller; and forming a plurality of pockets within the main geneva wheel;

engaging the first roller with one of the plurality of pockets as the chain drive rotates the first drive link past the main geneva wheel; and engaging the second roller with one of the plurality of pockets as the chain drive rotates the second drive link past the main geneva wheel.

4. The method recited by claim 3 including the steps of:

using the first roller to rotate the main geneva wheel through a first angular rotation of 90 degrees over a first period of time; and using the second roller to rotate the main geneva wheel through a second angular rotation of 90 degrees over a second period of time.

5. The method recited by claim 4 including the steps of:

engaging the main geneva wheel with the belt feed geneva wheel during the first period of time to rotate the belt feed geneva wheel by 90 degrees; and engaging the main geneva wheel with the round positioning geneva wheel during the second period of time to rotate the round positioning geneva wheel by 90 degrees.

6. The method recited by claim 5 including the steps of:

providing opposing first and second pins on the main geneva wheel;

providing a plurality of radial slots in the belt feed geneva wheel;

providing a plurality of radial slots in the round positioning geneva wheel;

periodically engaging one of the first and second pins with one of the plurality of radial slots in the belt feed geneva wheel to rotate the belt feed geneva wheel through a partial rotation; and periodically engaging one of the first and second pins with one of the plurality of radial slots in the round positioning geneva wheel to rotate the round positioning geneva wheel through a partial rotation.

7. The method recited by claim 6 including the step of positioning the belt feed geneva wheel in close proximity to the round positioning geneva wheel whereby each of the first and second pins of the main geneva wheel enters a radial slot of the round positioning geneva wheel substantially immediately after exiting from a radial slot of the belt feed geneva wheel.

8. The method recited by claim 1 further including the step of yieldingly engaging a detent with at least one of the belt feed and round positioning geneva wheels for maintaining the engaged geneva wheel in a fixed position until such geneva wheel is further rotated by the main geneva wheel.

9. A method of feeding of rounds of ammunition to a gun and positioning rounds for firing within the gun, the gun having a barrel for guiding fired rounds, the method including the steps of:

selectively rotating a chain drive about a track;

mounting a main geneva wheel for rotation proximate to the chain drive;

rotating the main geneva wheel through a first partial rotation, and through a second partial rotation, for each rotation of the chain drive about the track;

mounting a round feed geneva wheel for rotation proximate to the main geneva wheel for being periodically rotated thereby;

providing a round retractor for engaging and retracting rounds of ammunition;

coupling the round feed geneva wheel to a rotating round feeder for periodically feeding a round of ammunition into the round retractor;

providing a rotatable bolt feed rotor;

transferring a retracted round of ammunition from the round retractor to the bolt feed rotor;

mounting a round positioning geneva wheel for rotation proximate to the main geneva wheel for being periodically rotated thereby; and coupling the round positioning geneva wheel with the bolt feed rotor to move a retracted round of ammunition into alignment with the barrel of the gun.

10. The method recited by claim 9 including the further steps of:

securing a first drive link to the chain drive, and causing the first drive link to periodically travel past the main geneva wheel as the chain drive is rotated;

securing at least a second drive link to the chain drive spaced apart from the first drive link, and causing the second drive link to periodically travel past the main geneva wheel as the chain drive is rotated;

rotating the main geneva wheel through the first partial rotation as the first drive link travels past the main geneva wheel; and;

rotating the main geneva wheel through the second partial rotation as the second drive link travels past the main geneva wheel.

11. The method recited by claim 10 including the further steps of:

providing the first drive link with a first roller;

providing the second drive link with a second roller; and forming a plurality of pockets within the main geneva wheel;

engaging the first roller with one of the plurality of pockets as the chain drive rotates the first drive link past the main geneva wheel; and engaging the second roller with one of the plurality of pockets as the chain drive rotates the second drive link past the main geneva wheel.

12. The method recited by claim 11 including the steps of:

using the first roller to rotate the main geneva wheel through a first angular rotation of 90 degrees over a first period of time; and using the second roller to rotate the main geneva wheel through a second angular rotation of 90 degrees over a second period of time.

13. The method recited by claim 12 including the steps of:

engaging the main geneva wheel with the round feed geneva wheel during the first period of time to rotate the round feed geneva wheel by 90 degrees; and engaging the main geneva wheel with the round positioning geneva wheel during the second period of time to rotate the round positioning geneva wheel by 90 degrees.

14. The method recited by claim 13 including the steps of:

providing opposing first and second pins on the main geneva wheel;

providing a plurality of radial slots in the round feed geneva wheel;

providing a plurality of radial slots in the round positioning geneva wheel;

periodically engaging one of the first and second pins with one of the plurality of radial slots in the round feed geneva wheel to rotate the round feed geneva wheel through a partial rotation; and periodically engaging one of the first and second pins with one of the plurality of radial slots in the round positioning geneva wheel to rotate the round positioning geneva wheel through a partial rotation.

15. The method recited by claim 14 including the step of positioning the round feed geneva wheel in close proximity to the round positioning geneva wheel whereby each of the first and second pins of the main geneva wheel enters a radial slot of the round positioning geneva wheel substantially immediately after exiting from a radial slot of the round feed geneva wheel.

16. The method recited by claim 9 further including the step of yieldingly engaging a detent with at least one of the round feed and round positioning geneva wheels for maintaining the engaged geneva wheel in a fixed position until such geneva wheel is further rotated by the main geneva wheel.

* * * * *